US005451303A

United States Patent [19]

Heiler et al.

[11] Patent Number: 5,451,303

[45] Date of Patent: Sep. 19, 1995

[54] CLEANING HYDROPHILIC CONTACT LENSES BY ELECTROCHEMICAL MEANS

[75] Inventors: David J. Heiler, Avon; David A. Marsh, Rochester; Matthew S. Jonasse, Sodus; Rick Panicucci, Rochester, all of N.Y.

[73] Assignee: Bausch & Lomb Incorporated, Rochester, N.Y.

[21] Appl. No.: 175,883

[22] Filed: Dec. 30, 1993

[51] Int. Cl.[6] ..... C25B 7/00

[52] U.S. Cl. ..... 204/180.1; 134/42

[58] Field of Search ..... 204/130, 131, 180.1; 134/42

[56] References Cited

U.S. PATENT DOCUMENTS

| | | | |
|---|---|---|---|
| 4,473,550 | 9/1984 | Rosenbaum | 424/94 |
| 4,732,185 | 3/1988 | Cowle et al. | 134/84 |
| 4,775,424 | 10/1988 | Wisotzki et al. | 134/42 |
| 4,780,152 | 10/1988 | Itagaki et al. | 134/42 |
| 4,921,544 | 5/1990 | Cowle et al. | 134/1 |
| 4,976,921 | 12/1990 | Itagaki et al. | 422/28 |
| 5,209,783 | 5/1993 | Huth | 134/19 |
| 5,227,039 | 7/1993 | Pankow | 204/180.1 |
| 5,281,353 | 1/1994 | Park | 252/106 |

FOREIGN PATENT DOCUMENTS

| | | | |
|---|---|---|---|
| 0219220 | 4/1987 | European Pat. Off. | A61L 2/18 |
| 0458578A3 | 11/1991 | European Pat. Off. | A61L 2/18 |
| 0471352A1 | 2/1992 | European Pat. Off. | A61L 2/00 |
| 0487994A1 | 6/1992 | European Pat. Off. | A61L 2/18 |
| 2019600A | 10/1979 | United Kingdom | A61L 2/00 |

*Primary Examiner*—John Niebling
*Assistant Examiner*—C. Delacroix Muirheid
*Attorney, Agent, or Firm*—Craig E. Larson; Denis A. Polyn

[57] ABSTRACT

A composition and method for cleaning and disinfecting of contact lenses that employ an electrical field applied to a lens that causes contaminating deposits to migrate therefrom is described. The composition of the invention includes a pair of component materials having different electrochemical potentials wherein the materials are substantially contained in a form wherein each material remains sufficiently physically separated when in contact with opposite sides of the lens such that the difference in electrochemical potential between the two materials is sufficient to cause charged contaminating deposits to migrate from the lens. The method of the invention requires placing a contaminated lens between a pair of component materials having different electrochemical potentials wherein physical separation is maintained, preferably, by including one of the components in a gel while the other component is in solution or another gel. Preferably, one component of the pair of materials is an oxidizing agent while the second component is a reducing agent. An example of a suitable pair is hydrogen peroxide suspended in a carbopol gel and a solution of sodium thiosulfate, as the reducing agent. A lens is coated with the oxidant gel, placed in the reductant solution and held at room temperature for 2–4 hours, wherein the electrochemical field established between the pair achieves about a 29% protein removal.

13 Claims, No Drawings

CLEANING HYDROPHILIC CONTACT LENSES BY ELECTROCHEMICAL MEANS

BACKGROUND OF THE INVENTION

The field of the invention is cleaning of contact lenses by electrochemical or electrophoretic means. More particularly, contaminating deposits are removed from a contact lens by employing a small electrical current established through the lens that causes charged contaminating deposits, particularly protein contaminants, to migrate from the lens.

As is well known, contact lenses during wear become contaminated with deposits that adhere to the lenses over time. Proteins and lipids generated by the eyes' tear film, as well as microbial agents from the environment, adhere to the lenses such that they must be cleaned and disinfected frequently to preserve visual acuity and health of the wearer. Daily cleaners employing various surfactants are typically used to remove lipoid contaminants. The more difficult proteinaceous contaminants are removed by treating with enzyme. Disinfecting agents, such as hydrogen peroxide and other oxidants, are then utilized for disinfecting lenses, which agents often require reductants to neutralize residual oxidants before the lenses may be reinserted on the eye.

Typically, three separate regimens are involved in cleaning and disinfecting contact lenses in accord with the processes described above. It is well known that lens wearers do not always properly comply with lens care regimens, particularly where the regimen involves a number of components and steps. Thus, contact lens manufacturers and those concerned with lens care are always looking to simplify or combine lens care regimens.

One regimen or method which combines a number of cleaning and disinfecting steps utilizes electrophoretic techniques and apparatus. For example, Cowle et al in U.S. Pat. Nos. 4,732,185 and 4,921,544 describe a method for decontaminating and sterilizing a contact lens by electrophoresis wherein contact lenses, contained in a holder, are submerged in a buffer solution in which a unidirectional electrical field is established between two adjacent electrodes. Application of the unidirectional electrical field to the buffer solution results in the charging of protein and other contaminating materials on the lenses whereupon the charged contaminating materials migrate to an oppositely charged electrode. Since soft contact lenses are formed of a material having a matrix structure with pore sizes greater than the size of the typical contaminants, e.g. protein colloids, the contaminants are able to pass through the lens itself. Only relatively low voltage is required, for example, on the order of 9 volts DC at 200 milliamps.

A number of electrophoretic apparatus have been designed specifically for cleaning contact lenses. For example, Pankow in U.S. Pat. No. 5,227,039 describes a method and apparatus for cleaning and disinfecting contact lenses by electrokinetic means in which a pair of electrical transmission media members, formed of a pliant absorbent material and holding an electroconductive solution, receive a lens therebetween and help focus an electric current such that it cannot leak around the lenses. The current must flow through the lenses thus avoiding a disadvantage of other's apparatus such as the Cowle apparatus of U.S. Pat. No. '185. As a further advantage, the Pankow apparatus allows contaminants migrated from the lenses to be captured by the transmission media, thus preventing re-contamination of the cleaned lens.

A difficulty with these prior art methods and apparatus is that the apparatus must include a pair of electrodes and an electrical power source, such as a battery, for generating the required electrical field. The electrical field generating means adds considerable weight, bulk and complexity, as well as cost, to the known electrophoretic cleaning systems.

It would be an advantage to provide compositions and methods for cleaning and disinfecting contact lenses that eliminate the need for the conventional means or device for generating the required electrical field.

SUMMARY OF THE INVENTION

The present invention provides a composition and method for cleaning and disinfecting of contact lenses that employs an electrical field applied to the lenses, said field causing contaminating deposits to migrate therefrom. The composition of the invention comprises a pair of component materials having different oxidation potentials, said materials substantially contained in a form wherein each material may remain sufficiently physically separated when in contact with opposite sides of said lens such that said difference in electrochemical potential between the two materials is sufficient to cause charged contaminating deposits on said lens to migrate therefrom. The method of the invention comprises placing a contaminated lens between the pair of component materials that have different oxidation potentials, wherein the materials remain sufficiently separated on opposite sides of said lens such that an electrical field is generated between said materials wherein charged components of the contaminating deposits migrate from the lens. The composition and method of the invention removes proteinaceous, lipoid or microbial deposits from the lens and does not require a specially designed or structured device or apparatus.

The two materials having different oxidation potentials are preferably maintained on opposite sides of the lens to be cleaned by containing one of the materials in a gel while the other material may be in a separate gel or aqueous solution. The composition and method may also utilize a gel—gel system or even a solution—solution system wherein at least one component is retained in a porous structure or matrix in contact with one lens surface. The pair of component materials of the invention is preferably an oxidant-reductant pair having sufficient potential difference between them to cause the charged contaminants on the lens to migrate therefrom.

The cleaning method of the invention may be conducted at room temperature or at elevated temperature, preferably between about 5° to about 100° C. Preferably, differences in oxidation potentials between the oxidant and reductant are about 0.1 to 6.0 volts.

Preferably, one component of the pairs of materials is an oxidizing agent and the second component is a reducing agent, the components selected such that at completion of cleaning, residual oxidizing agent on the lens is neutralized by the reducing agent wherein the lens is free of oxidant and resides in a non-toxic media. A preferred oxidant for the cleaning composition of the invention is hydrogen peroxide, sodium persulfate or PVP-NaOCl. A preferred reductant in combination with the aforementioned oxidant is sodium thiosulfate or sodium bisulfite. The gelling agent of this invention may be any suitable agent compatible with contact lens eye care systems. Preferred gelling agents include a polyacrylicacid, carboxymethylcellulose, a polyoxypropylene-polyoxyethylene block copolymer or a silica gel.

DETAILED DESCRIPTION OF THE INVENTION

Electrophoretic separation of proteins is typically carried out by means of an electrical field impressed upon the charged molecules to be separated that is on the order of 200 volts at an electrode spacing of about 10 centimeters. Thus, a charged protein sample placed on a gel electrophoresis membrane surface migrates through a gradient of about 20 V/cm.

The average center thickness of a typical contact lens is very small, for example, for a B&L 58 lens, about 0.08 mm. Considering such a contact lens as an electrophoresis gel membrane, it is seen that a potential difference between electrodes located at each lens surface need not be very large to give gradients comparable to a conventional electrophoresis separation. Even a potential difference of 1.0 volt applied axially through a contact lens will give a gradient of about 100 V/cm.

A basic concept of the present invention is that one can remove charged contaminating deposits adhered to a contact lens by creating a free energy difference on opposite sides of the lens. The drive to equilibrium releases sufficient energy necessary to overcome the forces of absorption and adhesion which sequester the deposit to the lens. A simple calculation reveals that a considerable amount of energy is released in a 1.0 volt system, on the order of about 46 Kcal/mole. By comparison, hydrogen bonding forces, similar to those forces adhering contaminants to the contact lens surfaces, are on the order of 3–10 Kcal/mole.

Thus, for contact lens contaminating deposits, particularly those such as proteins, that are held to lens surfaces by non-covalent forces, a relatively small potential difference across the lens provides enough energy to remove the protein and clean the lens. Methods of creating the necessary potential difference across the lens surfaces are well known and described in the art noted above, heretofore utilizing conventional batteries or converter devices to provide the low DC power required.

The present invention employs a pair of component materials having different oxidation potentials, preferably an oxidant-reductant pair, to generate sufficient voltages to effect electrophoresis cleaning of contact lenses. This system has obvious advantages over the battery or conventional current converter systems or devices, relied upon by prior workers, that require a special treating apparatus that includes electrodes, batteries and related control systems. The oxidant-reductant pair components are separately contained or held in a form wherein the pair components can remain sufficiently physically separated when contacted with opposite sides of a lens, such that the difference in electrochemical potential between the pair establishes an electrical field sufficient to migrate charged contaminating substances from the lens surfaces. The present invention, utilizing such contained oxidant-reductant pair components, needs no external battery or electrical source, allowing cleaning to be conducted in a conventional lens vial or the like.

A preferred composition of the invention requires a water soluble oxidant-reductant component pair having an electrochemical potential difference between the components adequate to migrate contaminating deposits of protein from a contact lens surface, wherein preferably at least one of either the oxidant or reductant is suspended or dissolved in gelling agent. The other component of the pair is either suspended in a separate gel or dissolved in an aqueous solution.

An anionic gelling agent is preferred wherein it is believed that such an agent is able to impart a uniform negative charge to an otherwise positively charged protein contaminating deposit that enables the protein to be removed from both sides of the lens at the same time by application of the electrical field generated by the potential difference between the pair. A cleaning result of greater than 50% removal of protein may be achieved by the composition of the invention, which result is substantially greater than that achieved by many conventional ambient temperature enzyme cleaning regimens. The gel component is, in addition, a convenient method for separating the oxidant and reductant for a sufficient time interval such that cleaning is achieved.

A combination of gels, solids or liquids with other gels, solids, or liquids may all be utilized in contact lens cleaning regimens using this concept. Suitable oxidants are metals of or salts of copper (II), copper (I), iodate, periodate, silver, chlorate, ferrocyanide, perchlorate, iodine, iodophors, permanganate, silver oxide, chlorite, peroxides, benzoquinone, iron (III), hypochlorite, chloramines, nitrate, manganese dioxide, chlorophors, persulfate, ozone, silver (II), bromate or NAD+.

Suitable reductants are metals of or salts: iron (II), bisulfite, tin metal, formate, phosphite, hypophosphite, sulfur, thiosulfate, zinc metal, dithionite, manganese metal, aluminum metal, magnesium metal, dithiothreitol, $NADH_2$, ascorbate, ferricyanide or hydroquinone.

A key element of certain preferred embodiments of the invention is a gelling agent employed to give the contaminating deposits a negative electrical charge and to maintain the oxidant-reductant pair on separate sides of the lens for a sufficient time to allow the protein contaminants to migrate therefrom. Suitable gelling agents are: alginic acid, polyacrylic acid (carbopol), carboxymethylcellulose (CMC), gelatin, hyaluronic acid, hydroxyethylcellulose (HEC), hydroxypropylmethylcellulose (HPMC), polyoxypropylene-polyoxyethylene block copolymer (Pluronic), polyacrylamide, polyvinylalcohol, polyvinylalcohol and borate, povidone, silicon dioxide or polyoxypropylene-polyoxyethylene adduct of ethylene diamise (Tetronic).

In a preferred method of operation of the invention, either the oxidizing agent or the reducing agent may be placed in a gelling agent. The opposite component of the oxidant-reductant pair may be placed in a separate gel. Where both components are suspended in a gel, the gels are rubbed onto opposite sides of the protein deposit lens. After a period of time, the lenses are rinsed off removing contaminating protein that has migrated from the lens surfaces.

In another embodiment, a first component of the pair is suspended in the gelling agent while the second component is dissolved in the isotonic buffered solution. The gel is dispensed onto one side of the contact lens or deposited into a contact lens vial, for example, onto the bottom of said vial. A lens coated with the first component is dropped into a vial containing the second component or the lens to be cleaned is pressed onto the first component gel and then the solution containing the second component is poured over the top of the lens to fill the lens case. The lens is held at room temperature or at an elevated temperature for a desired period of time. At completion of the selected time, the lens is generally rinsed to remove gel residues and any solution containing the migrated contaminating proteins. Appropriate selection of the oxidant-reductant pair and treating conditions may result in a cleaned lens substantially free of oxidant residue such that the lens may be inserted directly into the eye without further cleaning or disinfecting.

A key element of the invention is the oxidant-reductant pair having an electrochemical potential difference between them that is effective to establish an electrical field sufficient to migrate contaminating deposits from a contact lens surface. The oxidation potential difference is at least about 0.1 to about 6.0 volts. A preferred oxidative potential difference is about 1.0 to about 2.5 volts.

The composition of the invention preferably includes a buffer system to maintain the lens at isotonic conditions suitable for reinsertion in the eye. The buffer is selected to maintain a preferred pH of about 6–8 and may be any convenient buffer system based on, for example, phosphates, borates, citrates or tris buffer. The preferred buffer system is phosphate.

The composition of the invention may further include appropriate surfactants that enhance cleaning by removing lipids. Lipid removal may be enhanced by selecting a gelling agent of the invention that includes surfactant capability or by adding desired lipid removing surfactants to the gel and/or solution environment. Examples of preferred classes of surfactants are nonionic, amphoteric, anionic or cationic. A preferred lipid removing agent is a polyoxypropylene-polyoxyethylene block copolymer.

Other important optional ingredients of the invention include compatible antimicrobial agents, tonicity adjusting agents, etc. Stabilizing agents for the various oxidants may be included.

The method of the invention principally requires placing a contaminated lens between an oxidant-reductant pair and maintaining component pair separation for a sufficiently long period such that cleaning takes place by migration of contaminating proteins and other contaminants from lens surfaces. The degree of removal is a function of the temperature conditions and length of time the reaction is allowed to proceed. Preferably, the cleaning method is conducted at a temperature of about 5° to about 100° C. The lower the temperature the greater the time that will be required to achieve a desired degree of cleaning. To achieve a 50% removal of protein at room temperature (about 23° C.) a typical reaction time of about two hours is required. Where the cleaning takes place at elevated temperature, for example, at about 80°–100° C., a time of about 0.3–0.5 hour is required to achieve 50% removal. An advantage of elevated temperature cleaning, to at least about 80° C., is that the cleaned lenses are also disinfected.

The method of the invention requires coating at least one side of the lens with a component of the oxidant-reductant pair suspended in a gel. The gel may be applied by spreading or rubbing it onto one lens surface or the lens may be pressed into a quantity of gel held, for example, in a lens vial.

Where the second component of the electrochemical pair is dissolved in a solution, a coated lens may then be simply dropped into the second component solution. Where the lens is pressed into a quantity of gel in the lens case, the second component solution may be added thereafter.

The lenses are then held at desired temperature conditions for the period necessary to achieve a desired level of cleaning. After cleaning, the lenses are rubbed and rinsed with saline or other suitable solution.

In an alternative embodiment of the invention both components of the oxidant-reductant pair may be in solution with at least one component retained in a porous matrix material that is then placed into contact with one side of the lens to be cleaned. The porous matrix which may be a foam or sponge-like material holds the solutions sufficiently separate such that cleaning may proceed.

The following examples demonstrate the invention but are not limiting of its scope.

EXAMPLE 1

The cleaning efficacy of electrochemical oxidant-reductant pairs, having electrochemical potential differences between components of the pair, is measured for Softmate B soft contact lenses (FDA group III, having a water content of 45% and manufactured by Barnes-Hind). Either the oxidant or reductant is contained in a gel while the other component is dissolved in aqueous solution. The Softmate B lenses are prepared for the study by heating them, in a thermal lens treating device, manufactured by Bausch & Lomb of Rochester, N.Y. wherein each lens holder is filled with 3 milliliters of saline solution including 0.1% lysoyzme.

Oxidant-reductant gels are prepared by suspending 0.1M sodium persulfate and 3% $H_2O_2$, respectively, in a 2.75% gel of carbopol 940 (a polyacrylic acid manufactured by B. F. Goodrich Company). A 0.15M sodium thiosulfate gel is prepared in a 2.5% gel of carboxylmethylcellulose (CMC).

The second component of a cleaning electrochemical pair is provided by preparing a 0.15M sodium thiosulfate solution or 3% hydrogen peroxide solution in distilled water, respectively.

The cleaning regimen includes applying a coating of a test gel to one side of a contact lens and dropping the coated lens into a cleaning solution containing the second component of the oxidant-reductant pair. The test lenses are then held in the test solution for one of three test periods: at room temperature (RT) of about 23° C. for 2 hours; RT for 4 hours; and treated for a heat cleaning cycle in a lens holding apparatus at about 80° C. for about 20 minutes. Control examples of contact lenses were treated with saline solution only (Bausch & Lomb SENSITIVE EYES ® Saline Solution (SES)) a borate buffered, sorbic acid preserved NaCl solution and then subjected to the cleaning temperature/time cycle or regimen.

Following the cleaning regimen, the test lenses are rubbed and rinsed with SES and held in SES for 45 minutes. The lenses are then analyzed for residual protein adherent by ninhydrin assay as described by G. Minno, L. Eckel, S. Groemminger, B. Minno and T. Wrzosek, in "Quantitative Analysis of Protein Deposits on Hydrophilic Contact Lenses," *Optometric and Vision Science*, Vol. 68, No. 1, pp. 865–872.

Table I reports the average results achieved for 5 whole lenses tested at each level.

TABLE I

| Oxidant-Reductant Pair (form) | | Gelling Agent | Temp/Time (°C.) hrs | Protein Removal (%) |
|---|---|---|---|---|
| $H_2O_2$ (gel)[1] | Thiosulfate[2] (soln) | carbopol[3] | RT[4], 2 hr | 28.2 |
| $H_2O_2$ (gel) | Thiosulfate (soln) | carbopol | RT, 4 hr | 29.8 |
| $H_2O_2$ (gel) | Thiosulfate (soln) | carbopol | Heat[5], 1 cycle | 75.0 |
| $H_2O_2$ (soln) | Thiosulfate (gel) | CMC6 | RT, 2 hrs | 50.0 |
| $H_2O_2$ (soln) | Thiosulfate (gel) | CMC | RT, 4 hrs | 34.0 |
| Persulfate[7] (gel) | Thiosulfate (soln) | carbopol | RT, 2 hrs | 51.9 |
| Persulfate (gel) | Thiosulfate (soln) | carbopol | RT, 4 hrs | 42.3 |
| Persulfate (gel) | Thiosulfate (soln) | carbopol | Heat, 1 cycle | 58.3 |
| Control-saline | — | None | Heat, 1 cycle | — |

Notes:
1. 3% $H_2O_2$ solution
2. 0.15M solution of $Na_2S_2O_3$
3. 2.75% gel of carbopol 940 (a polyacrylic acid, manufactured by B.F. Goodrich of Cleveland, Ohio
4. Room temperature is about 23° C.
5. The heating regimen is about 80° C. for about 20 minutes.
6. 0.15M Sodium thiosulfate - 2.5% carboxymethyl cellulose (CMC)
7. 0.1M sodium persulfate in Carbopol 940

The results demonstrate that the compositions and method of the invention can achieve cleaning that is better than conventional enzyme cleaners at ambient temperature.

EXAMPLE 2

The test procedures of Example 1 are substantially repeated, substituting 30% Pluronic~F127, a polyoxypropylene-polyoxyethylene block copolymer sold by Wyandotte Chemical Corp., as the gelling agent. Gels containing 0.1M sodium persulfate, $H_2O_2$ and sodium thiosulfate, respectively, are made up. A 0.15M sodium thiosulfate solution and a 3.0% hydrogen peroxide solution, respectively, are made up, constituting the second component of the oxidant-reductant pair.

Softmate B lenses are coated on one side of the contact lenses by applying the selected gel thereto in either: a "thick" coat; or a film just sufficient to insure coverage—a "thin" film. The lenses were then dropped into the appropriate cleaning solution. The cleaning regimen included holding the lenses in solution in a thermal disinfecting device for 1 cycle, i.e. 80° C. for 0.3 hours. The lenses are rubbed and rinsed with saline after the cleaning regimen is complete and held in saline for 45 minutes. The lenses were then analyzed as in Example 1 and the results are presented in Table II.

TABLE II

| Oxidant-Reductant Pair (form) | Gelling Agent | Relative Amount of Gel Coating | Temp/Time (°C.) (hrs) | Protein Removal (%) |
|---|---|---|---|---|
| Persulfate (gel) - Thiosulfate (soln) | Pluronic F127 | thick | 80/0.3 | 43.4 |
| Persulfate (gel) - Thiosulfate (soln) | Pluronic F127 | thin | 80/0.3 | 35.5 |
| $H_2O_2$ (gel) - thiosulfate (soln) | Pluronic F127 | thick | 80/0.3 | 53.5 |
| $H_2O_2$ (gel) - Thiosulfate (soln) | Pluronic F127 | thin | 80/0.3 | 10.6 |
| Control - B&L Sensitive Eyes | None | None | 80/0.3 | 0 |
| Saline | | | | |

EXAMPLE 3

The test procedures of Example 1 are substantially repeated, but substituting 20% by weight silica gel, Syloid 244FP (Davison Chemical of Baltimore, Md.) for the gelling agent. The test results are presented in Table III.

TABLE III

| Oxidant-Reductant Pair (form) | | Gelling Agent | Temp/Time (°C.) hrs | Protein Removal (%) |
|---|---|---|---|---|
| $H_2O_2$ (gel) | Thiosulfate (soln) | silica | RT, 2.5 hrs | 14.5 |
| $H_2O_2$ (gel) | Thiosulfate (soln) | silica | 80° C., 0.3 hrs. | 24.8 |
| Thiosulfate (gel) $H_2O_2$ (soln) | | silica | RT, 2.5 hrs. | 16.1 |
| Persulfate (gel) Thiosulfate (soln) | | silica | 80° C., 0.3 hrs | 19.9 |
| No gel - Saline (soln) | | silica | control | 0 |

EXAMPLE 4

The test procedures of Example 1 are substantially repeated for Softmate B lenses utilizing a 30% aqueous Pluronic F127 gel containing sodium persulfate (O.15M) as the oxidant and, as the reductant, sodium bisulfite in a 0.15M aqueous solution. A heat cycle cleaning regimen of 80° C. for 0.3 hour is completed, achieving a 23.4% removal of residual protein over control lenses.

EXAMPLE 5

The composition and method of the invention are also demonstrated in a two gel system wherein a first gel includes the oxidant and a second gel includes the reductant. The procedures of Example 1 are substantially repeated, except that the oxidant is rubbed onto one side of a protein deposited lens while the reductant is rubbed onto the opposite side of the lens. After the indicated time, the gels are rinsed off and the residual protein determined. The results are reported in Table IV for the gel—gel cleaning system.

TABLE IV

Two Gel System (30% aq. Pluronic F127)

| Oxidant (gel) | Reductant (gel) | Lens Type | Temp. Time | % Protein Removal |
|---|---|---|---|---|
| $Na_2S_2O_8$(0.1M) | $Na_2S_2O_3$(0.1M) | Softmate | RT[2], 4 hr | 27.7% |
| $Na_2S_2O_8$(0.1M) | $NaHSO_3$(0.1M) | Softmate | RT, 4 hr | 40.9% |
| PVP-NaOCl[1] | $NaHSO_3$(0.1M) | Softmate | RT, 4 hr | 39.2% |
| $Na_2S_2O_8$(0.15M) | $NaHSO_2$ (0.15M) | Softmate | RT, 4 hr | 49.8% |
| $Na_2S_2O_8$(0.15M) | $NaHSO_3$ (0.15M) | Softmate | RT, 4 hr | 51.9% |

Notes:
1. A gel of 2.5% PVP and 0.25% NaOCl in saline solution.
2. Room Temperature is about 23° C.

EXAMPLE 6

The composition and method of the invention are demonstrated by a metal pair having electrochemical potential differences between components of the pair. Cleaning of contact lenses is conducted by a Cu/Zn pair in a gel—gel system. Two (2) grams of polyacrylamide (MW=5,000,000) are dissolved in 100 ml of distilled water, forming a thick gel-like solution. 0.861 grams of zinc chloride dihydrate are dissolved in 50 mL of the polyacrylamide gel to form a 0.1 molar solution. 0.852 grams of copper chloride dihydrate are dissolved in a second 50 mL portion of the polyacrylamide gel to form a 0.1 molar solution. Next, 325 mesh powdered zinc metal is added to the zinc chloride gel and 325 mesh powdered copper metal is added to the copper chloride gel. Four protein deposited Etafilcon A lenses (FDA Group IV lenses having a 58% $H_2O$ water content, manufactured by Bausch & Lomb of Rochester, N.Y.) are then placed between the two different gels and allowed to stand at room temperature for 2 hours. At the end of this time, the lenses are rubbed and rinsed with distilled water to remove any remaining gel. The lenses were then analyzed by "Grey Scale Image Analysis" to determine if there is protein removal, using Image Measures Software developed by Microscience, Inc. of Federal Way, Wash., on a personal computer equipped with a PC vision video digitizer board made by Imaging Technology, Inc. of Woburn, Mass. A lower Grey Scale number indicates that the lens is relatively less transparent (i.e. more protein on lens).

TABLE V

| Lens Number | Ave. Grey Scale Before Treatment | Ave. Grey Scale After Treatment |
|---|---|---|
| 1 | 175 | 207 |
| 2 | 180 | 220 |
| 3 | 175 | 219 |
| 4 | 155 | 212 |
| Fresh Lens | 217 | — |

In a second sample, the Cu/Zn pair is employed in cleaning contact lenses in a gel-gel system wherein Pluronic F127 is the gelling agent. Twenty (20) grams of Pluronic F127 is dissolved in 100 mL of distilled water to form a thick gel-like solution. 0.861 grams of zinc chloride dihydrate is dissolved in 50 mL of the pluronic gel to form a 0.1 molar solution. 0.852 grams of copper chloride dihydrate is dissolved in a second 50 mL portion of the pluronic gel to form a 0.1 molar solution. Next, 325 mesh powdered zinc metal is added to the zinc chloride gel and 325 mesh powdered copper metal is added to the copper chloride gel. Six protein deposited Etafilcon A lenses are then placed between the two different gels and allowed to stand at room temperature for 4 hours. At the end of this time, the lenses are rubbed and rinsed with distilled water to remove any remaining gel. The lenses are analyzed using the ninhydrin method as found in Example 1. A 26% protein removal is observed for this system.

It should be apparent to those skilled in the art that the present invention is not limited by the samples set forth above and that the use of specific compositions can be determined from the specification without departing from the invention as herein disclosed and described. It should be understood that the scope of the present invention includes all modifications and variations that fall within the scope of the attached claims.

What is claimed is:

1. In a method of removing contaminating deposits from a contact lens, the improvement which comprises:

(a) providing a pair of component materials having different oxidation potentials;

(b) placing a contaminated lens between the pair of component materials such that each of said materials is maintained in contact with opposite sides of the lens and the materials remain sufficiently physically separated such that charged components of the contaminating deposits migrate from the lens by operation of the electrochemical forces created by said pair of materials;

(c) maintaining the lens in contact with the pair of component materials for a time sufficient to clean the lens; and (d) removing the lens from the pair of component materials.

2. The method of claim 1 wherein the pair of component materials is an oxidant-reductant pair and the oxidant material is a metal or salt of copper (II), copper (I), iodate, periodate, silver, chlorate, ferrocyanide, perchlorate, iodine, iodophor, permanganate, silver oxide, chlorite, peroxides, benzoquinone, iron (III), hypochlorite, chloramines, nitrate, manganese dioxide, chlorophors, persulfate, ozone, silver (II), bromate or NAD+, and the reductant material is a metal of or salt of iron (II), bisulfite, tin formate, phosphite, hypophosphite, sulfur, thiosulfate, zinc, dithionite, manganese, aluminum, magnesium, dithiothreitol, $NADH_2$, astorbate, ferricyanide or hydroquinone.

3. The method of claim 2 wherein the difference in oxidation potentials between said oxidant and reductant is about 0.1 to about 6.0 volts.

4. The method of claim 1 wherein at least one of the materials comprises a gel.

5. The method of claim 4 wherein the oxidant material is suspended in a gel and the reductant material is dissolved in an aqueous solution.

6. The method of claim 4 wherein the reductant material is suspended in a gel and the oxidant material is dissolved in an aqueous solution.

7. The method of claim 4 wherein each of the component materials is dissolved in an aqueous solution and at least one of the aqueous solutions is retained in a porous matrix that conforms to a surface of the lens.

8. The method of claim 4 wherein each of the component materials is contained in a separate gel.

9. The method of claim 4 wherein said gel comprises a gelling agent that is alginic acid, polyacrylic acid, carboxymethylcellulose, gelatin, hyaluronic acid, hydroxyethylcellulose, hydroxypropylmethylcellulose, polyoxypropylene-polyoxyethylene block copolymer, polyacrylamide, polyvinylalcohol, polyvinylalcohol and borate, povidone, silicon dioxide, or polyoxypropylene-polyoxyethylene adduct of ethylene diamine.

10. The method of claim 1 wherein the contaminating deposits comprise proteinaceous, lipoid or microbial deposits resulting from wearing of said contact lenses.

11. The method of claim 1 wherein said method is conducted at a temperature of about 5° to 100° C.

12. The method of claim 1 wherein the contact lens is rubbed and rinsed after removing the lens from the pair of component materials.

13. The method of claim 12 wherein the contact lens is rubbed and rinsed with a saline solution after removing the lens from the pair of component materials.

* * * * *